US007589439B2

(12) United States Patent
Raisanen

(10) Patent No.: US 7,589,439 B2
(45) Date of Patent: Sep. 15, 2009

(54) ELECTROMECHANICAL TRANSDUCER ELEMENT, METHOD FOR FORMING AN ELECTROMECHANICAL TRANSDUCER ELEMENT AND TRANSDUCER FORMED BY SAID METHOD

(75) Inventor: Heikki Raisanen, Jyvaskyla (FI)

(73) Assignee: B-Band Oy, Vaajakoski (FI)

( * ) Notice: Subject to any disclaimer, the term of this patent is extended or adjusted under 35 U.S.C. 154(b) by 101 days.

(21) Appl. No.: 10/894,417

(22) Filed: Jul. 14, 2004

(65) Prior Publication Data

US 2005/0035683 A1 Feb. 17, 2005

Related U.S. Application Data

(63) Continuation of application No. PCT/FI03/00035, filed on Jan. 17, 2003.

(30) Foreign Application Priority Data

Jan. 17, 2002 (FI) ..... 20020092

(51) Int. Cl.
*G11C 13/02* (2006.01)

(52) U.S. Cl. ..... 307/400

(58) Field of Classification Search ..... 307/400
See application file for complete search history.

(56) References Cited

U.S. PATENT DOCUMENTS

| | | | |
|---|---|---|---|
| 4,400,634 | A | 8/1983 | Micheron |
| 4,419,545 | A | 12/1983 | Kuindersma |
| 4,533,794 | A | 8/1985 | Beveridge |
| 4,885,783 | A | 12/1989 | Whitehead et al. |
| 5,682,075 | A | 10/1997 | Bolleman et al. |
| 6,078,006 | A | 6/2000 | Räisänen et al. |
| 6,483,924 | B1 | 11/2002 | Kirjavainen |
| 2003/0007659 | A1 | 1/2003 | Kirjavainen |
| 2003/0052570 | A1 | 3/2003 | Kirjavainen |

FOREIGN PATENT DOCUMENTS

| | | |
|---|---|---|
| DE | 35 42 458 | 6/1986 |
| FI | 105238 | 5/2000 |
| FI | 20002780 | 6/2002 |

(Continued)

OTHER PUBLICATIONS

International Search Report dated Apr. 22, 2003.

(Continued)

*Primary Examiner*—Fritz M Fleming
*Assistant Examiner*—Dru M Parries
(74) *Attorney, Agent, or Firm*—Katten Muchin Rosenman LLP

(57) ABSTRACT

Electromechanical transducer element for converting mechanical force, such as vibrations, into electrical signals and a method for fabricating the same, the transducer having a layered structure and comprising: signal and ground layers (103-105, 107) and dielectric layer(s) (109, 110), the dielectric layers being permanently charged elastic cellular electret film layer(s), and wherein the transducer element is provided with additional material in order to improve the electric properties, and wherein in that the additional material (108, 106) is disposed in between the permanently charged elastic cellular electret film and at least one electrode of the element so that under compression the elastic electret film compresses most at the areas being directly against the additional material and less at the other areas of the element.

16 Claims, 4 Drawing Sheets

FOREIGN PATENT DOCUMENTS

| | | |
|---|---|---|
| WO | WO 96/06718 | 3/1996 |
| WO | WO 97/48253 | 12/1997 |
| WO | WO 99/56498 | 11/1999 |
| WO | WO 01/02823 | 1/2001 |
| WO | WO 02/51202 | 6/2002 |
| WO | WO 02/085065 | 10/2002 |

OTHER PUBLICATIONS

Interim Decision dated Jan. 29, 2004.
Interim Decision dated Oct. 25, 2002.

ELECTROMECHANICAL TRANSDUCER ELEMENT, METHOD FOR FORMING AN ELECTROMECHANICAL TRANSDUCER ELEMENT AND TRANSDUCER FORMED BY SAID METHOD

This application is a continuation of prior PCT application No. FI 03/00035, filed Jan. 17, 2003.

FIELD OF INVENTION

The present invention relates to an electromechanical transducer element for converting force and pressure changes and vibrations into electrical signals and to a method for its fabrication. Present invention is especially useable as musical instrument transducer for converting vibrations into electrical signals and, in particular, to an flexible unitary under-saddle transducer element,

PRIOR ART

WO 97/39602 presents a stringed musical instrument transducer for converting string vibrations into electric signals, which transducer is composed of elastic, voided electret-film sheets and is capable of converting string vibrations into electric signals. The electrodes required by the electromechanical sheet are disposed on the surface of one or more thin and flexible dielectric materials, said electrodes forming electrically conductive surfaces of the transducer for connecting the transducer to a signal processing device, and which transducer is constructed of a unitary, thin and flexible layered sheet structure.

In the transducer described in WO 97/39602, signal and ground electrodes are arranged on the insulate sheet. As electrodes are printed with silver-paste, they are typically about 20 μm thick layers on the insulate sheets, which can be for example 100 μm thick polyester. Lack of the prior art transducers where voided electret-film is used as electromechanical film, is that when the transducer is under continuous high pressure, which is the case in many applications like under-saddle transducer in acoustic guitar, the electromechanical film compresses constantly and its output gets lower and lower upon time. This happens because under high pressure the gas inside voids diffuses and therefore the elasticity of the film drops which further causes the distance of the layers with opposite charges inside film getting smaller.

For example from U.S. Pat. No. 4,885,783 it is known to use electrical insulating material in order to increase the gas breakdown voltage and to lessen the deleterious effects of accidentally exceeding the voltage. U.S. Pat. No. 4,885,783 pertains to electrical-to-mechanical transducers. More particularly, the application pertains to an electro-static transducer in which an elastomeric dielectric material is disposed between a pair of opposed conductive plates across which an electrical potential difference is maintained. A plurality of strips, beads or nodules of elastomeric dielectric material are disposed between plates and in contact therewith, thereby separating plates by a distance "d" such that, for a given gas maintained between plates at a pressure "P", the product Pd is significantly less than the value required to achieve the Paschen minimum breakdown voltage of the gas.

SUMMARY OF THE INVENTION

The object of the present invention is to eliminate the drawbacks of prior art and achieve an improved transducer, in which a dielectric swelled cellular (voided) electret film is used to transform the mechanical stress into electric signals. In the present invention, adjacent to the signal electrode and/or possibly partly onto it, is deposited a layer of isolating material, for example by screen-printing a lacquer layer, and partly onto the ground electrode is deposited another layer of silver-paste, which also can be dielectric lacquer. This way arranging bosses or stripes against the elastic voided electromechanical film, the film, when the transducer is continuously under high pressure, like is the case with under the saddle transducers due the tension of the strings, compresses most only at the sides of the sensor. In the middle, over the actual signal electrode area, is left a area (space) where the voided film cannot compress entirely due the fact the thicker sides prevent from it to happen. With this construction the transducer generates much higher voltage output, typically about 6 dB more, which is essential for good signal-to-noise ratio and studio quality sound production, than with a conventional prior art transducer. Also, the output level remains better constant upon time.

It is also possible to otherwise generate bosses to the signal electrode and/or ground electrode to achieve the similar effect of the invention, for example by etching in case if pure metal electrodes are used.

The invention is in detail defined in the attached claims.

The structure of the invention thus allows the application of an effective and economic production technique with significantly improved electrical properties.

BRIEF DESCRIPTION OF THE DRAWINGS

In the following, the invention is described in more detail by the aid of examples by referring to the attached drawings, in which.

DETAILED DESCRIPTION

Figure 1A:
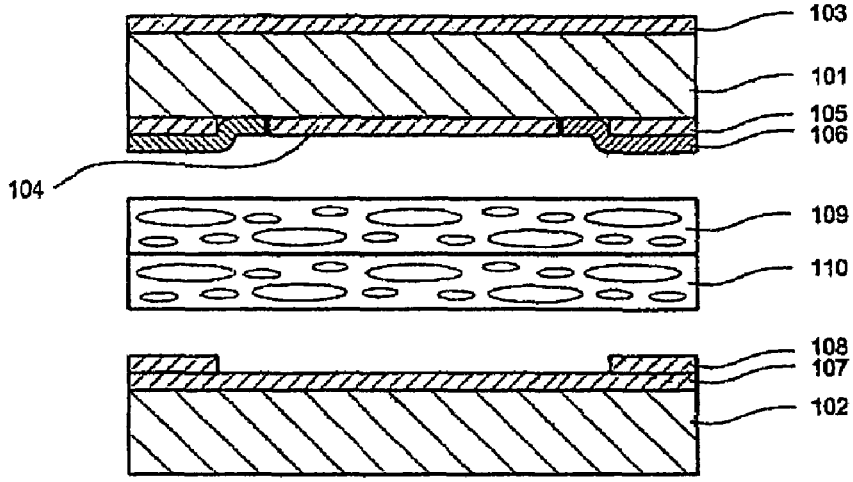
FIG. 1*a* presents a cross-sectional view of the transducer, in this case a musical instrument transducer, according to the invention.
Figure 2A:
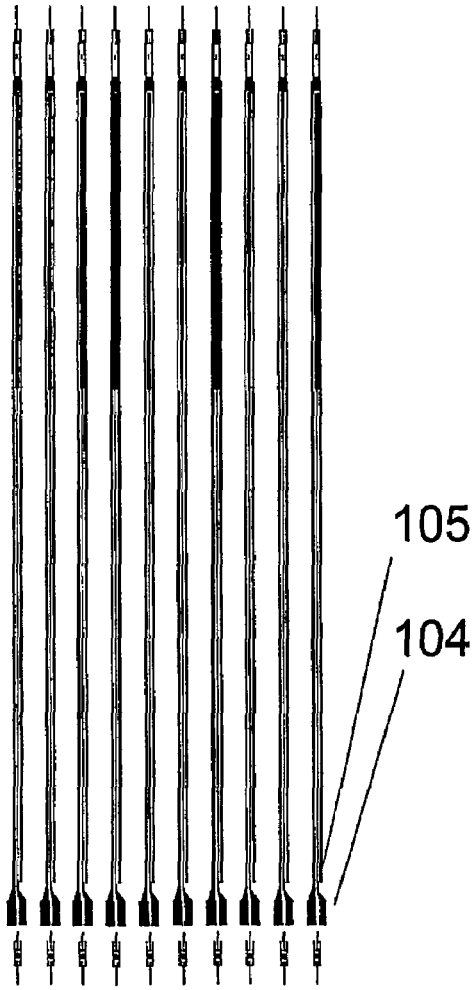
FIG. 2*a* presents a screen-print film for printing the signal and ground electrode layers of the transducer in FIGS. 1*a* and 1*b*.
Figure 2B:
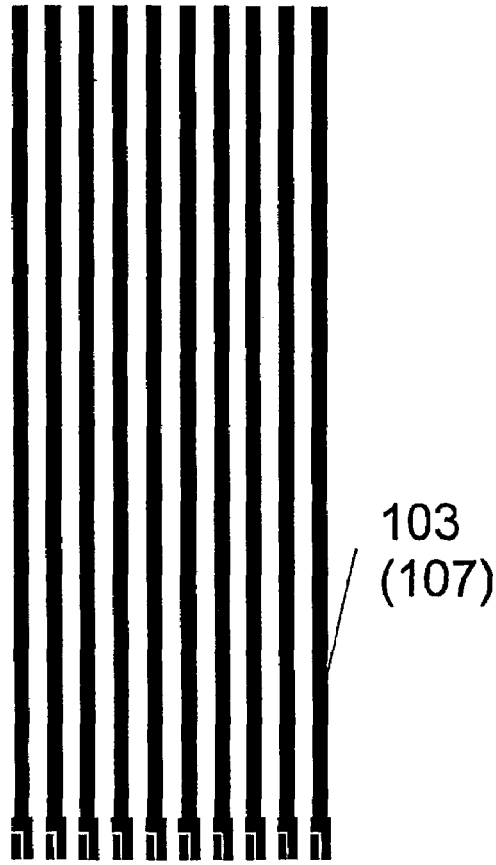
FIG. 2*b* presents a screen-print film for printing the ground electrode layers of the transducer in FIG. 1*a* and 1*b*.
Figure 2C:
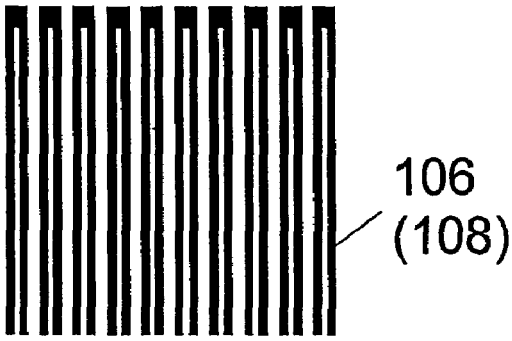
FIG. 2*c* presents, according the present invention, a screen-print film for printing the dielectric layers adjacent to signal electrode and additional silver-paste layers onto ground electrode layer
Figure 2D:
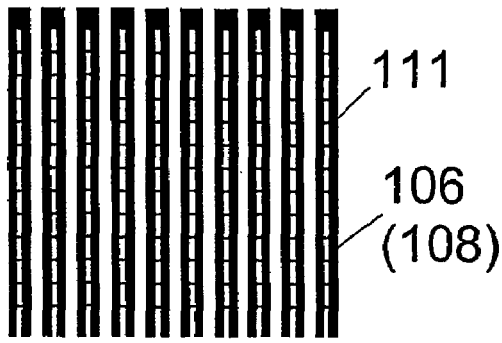
FIG. 2*d* presents, according the present invention, another screen-print film for printing the dielectric layers adjacent to signal electrode and additional silver-paste layers onto ground electrode layer

The transducers of invention in FIG. 1*a* consists of a two plastic films, 101 and 102, for example polyester, with thickness typically 100 μm. On the upper side of the film 101 is printed a ground electrode layer 103, screen-printed according to FIG. 2*b*, with thickness about 20 μm. Under the film 101 has first been printed at same time the signal electrode layer 104 and ground-loop electrode 105, accordingly to FIG. 2*a*, both typically having thickness of 20 microns. Following this printing is printed dielectric layer 106 accordingly to FIG. 2*c*, also having thickness of about 20 μm. 100 μm thick polyester film 102 has on upper side 20 μm ground electrode layer 107, printed with FIG. 2*b*. Partly onto the ground electrode layer is printed another about 20 μm layer 108 with silver-paste, by using film as in FIG. 2*c*. FIG. 2*d*shows another kind arrangement, where there comes additional, thin, for example about 0.3 mm wide, crossing lines 111 over both signal and ground electrodes. This kind arrangement is needed if the transducer has greater width in both x- and y-directions.

Figure 1B:
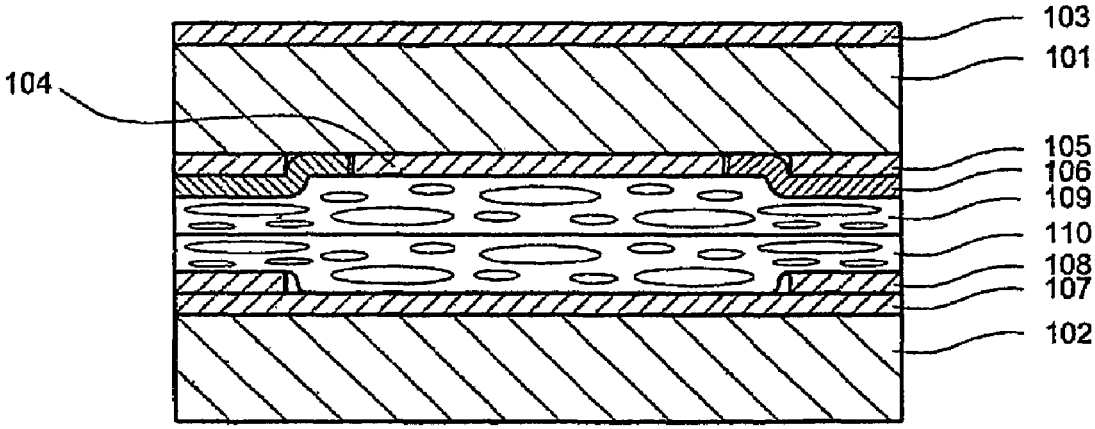
FIG. 1*b* presents a cross-sectional view of the transducer according to the invention, which have been under high pressure
Figure 3:
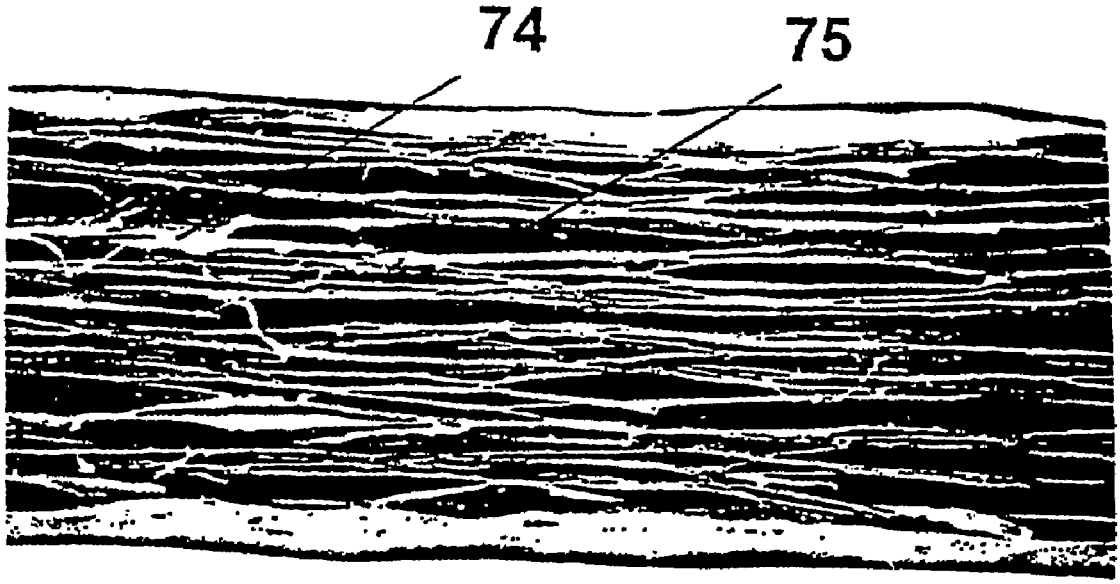
FIG. 3 presents a microscope picture of swelled dielectric cellular electret bubble film.

The films 109, 110 are active electromechanical films, being composed of permanently charged dielectric electret films 74 containing flat lens-like gas bubbles 75 or blisters (so called electret bubble film, FIG. 3). In typical electromechanical transducer application films 109, 110 have originally been about 50 μm elastic electric films with about 35% gas of the thickness, which further have been swelled to about 70 microns thickness (about 55% gas of the thickness) and charged. The cross-sectional view in FIG. 1*b* clearly shows how in the structure of the present invention, when the transducer is under high pressure, over the area of the signal electrode, there is a space for the voided transducer film not to compress entirely. Typically two layers of elastic electret films are used for higher output. If the total thickness of the two layers 108,109 is 140 μm, they can compress in the side areas 106, 107 down to about 65 μm. In the area of the signal electrode they can compress only down to about 105 μm. This will remain constant, significantly higher output level upon time under high pressure.

As is known in prior art transducers, number of electromechanical layers and their order can vary a lot. Signal and ground electrodes, as well as the additional isolation and/or conductive layers, can also be printed directly into elastic charged electret films which further can be laminated together. Another embodiment of the invention is for example to take two sheets of elastic electret film and having signal electrode printed on one side of them and ground electrode on opposite sides. By further printing the additional layers onto signal electrodes, to comprise the bosses or stripes, and laminating the two sheets of electret films together by having the signal electrodes against each other, extremely thin transducer can be achieved where no additional polyester or else layers are needed. Yet the structure will have same innovative benefit.

It is obvious to the person skilled in the art that different embodiments of the invention are not restricted to the examples described above, but that they can be varied within the scope of the claims presented below. The number of films and layers on top of each other can be chosen in accordance with the need in each case and the transducer can also have a shape other than rectangular in top view.

The invention claimed is:

1. Electromechanical transducer element for converting mechanical force changes into electrical signals, the transducer having a layered structure and comprising:

a signal layer and at least one ground layer (103-105, 107) and dielectric layers comprising at least one charged elastic cellular electret film layer;

a plurality of embossing structures essentially smaller than the signal and ground electrode layers in order to improve the electric properties, the embossing structures being separate structures from the signal and ground layers;

the plurality of embossing structures sandwiching the at least one charged elastic cellular electret film layer and at least one electrode layer at certain areas essentially smaller than the signal and ground electrode layers, the plurality of embossing structures arranged under pressure in order to compress the at least one charged elastic cellular electret film layer most at the plurality of embossing structures and less elsewhere, and wherein the plurality of embossing structures comprises a dielectric or electrically conducting material.

2. The electromechanical transducer element according to claim 1, wherein adjacent to the signal electrode and/or partly onto it, is deposited a layer of isolating material.

3. The electromechanical transducer element according to claim 1, wherein partly onto the ground electrode is deposited another layer of conductive layer material, said conductive material comprising silver-paste.

4. The electromechanical transducer element according to claim 1, wherein the at least one charged elastic cellular electret film layer comprises a biaxially oriented foamed film layer comprising essentially flat gas bubbles.

5. The electromechanical transducer element according to claim 4, wherein the biaxially oriented foamed film layer is swelled.

6. A method for forming an electromechanical transducer element for converting mechanical force into electrical signals, the transducer having at least one transducer film (109, 110) of permanently charged elastic dielectric cellular electret film, the method comprising following steps:

arranging at least one signal electrode (104) and at least one ground electrode (105, 107) on surfaces of a transducer film element; and arranging a plurality of embossing structures in order to improve the electric properties, the plurality of embossing structures being separate structures from the signal and ground layers;

wherein a compression means (108, 106) is disposed between the permanently charged elastic dielectric cellular electret film and at least one electrode layer at certain areas essentially smaller than the signal and ground electrodes and arranged under pressure in order to compress the elastic electret film most at the plurality of embossing structures and less elsewhere, and wherein the plurality of embossing structures comprises a dielectric or electrically conducting material.

7. The method according to claim 6, wherein adjacent to the signal electrode and/or partly onto it, is deposited a layer of isolating material.

8. The method according to claim 6, wherein partly onto the ground electrode is deposited another layer of conductive layer material, said conductive material comprising silver-paste.

9. An electromechanical transducer element for converting mechanical force changes into electrical signals, the transducer comprising:

a layered structure comprising a dielectric layer sandwiched between a pair of signal and ground layers, the dielectric layer comprising a permanently charged elastic cellular electret film layer;

a plurality of embossing structures discontinuous over a first area and continuous over a second area, the first area being defined between thicker sides formed by respective ones of the plurality of embossing structures, the dielectric layer comprising a substantially uncompressable state in the first area, the dielectric layer comprising a compressible state in the second area.

10. The electromechanical transducer element of claim 9, wherein a layer of isolating material is disposed adjacent to the signal layer.

11. The electromechanical transducer element of claim 9, wherein a layer of isolating material is disposed on the signal layer.

12. The electromechanical transducer element of claim 9, wherein the ground layer is disposed on a layer of a conductive layer material.

13. The electromechanical transducer element of claim 12, wherein the conductive material comprises silver-paste.

14. The electromechanical transducer element of claim 9, wherein the dielectric layer comprises a biaxially oriented foamed film layer having flat gas bubbles.

15. The electromechanical transducer element of claim 9, wherein the dielectric layer comprises a biaxially oriented foamed film layer having flat gas bubbles that are swelled.

16. The electromechanical transducer element of claim 1, wherein the at least one charged elastic cellular electret film layer is permanently charged.

* * * * *